United States Patent [19]

Kuo et al.

[11] Patent Number: 5,037,670

[45] Date of Patent: Aug. 6, 1991

[54] METHOD OF MANUFACTURING A LOW SHEET RESISTANCE ARTICLE

[75] Inventors: Charles C. Y. Kuo, Elkhart; Tom O. Martin, Nappanee, both of Ind.

[73] Assignee: CTS Corporation, Elkhart, Ind.

[21] Appl. No.: 430,227

[22] Filed: Nov. 1, 1989

[51] Int. Cl.[5] ..... B05D 5/12

[52] U.S. Cl. ..... 427/102; 427/123; 427/126.2; 427/191; 427/192; 427/193; 427/199; 427/201; 427/279; 427/376.3

[58] Field of Search ..... 427/191, 102, 192, 123, 427/423, 126.2, 193, 199, 201, 279, 376.3

[56] References Cited

U.S. PATENT DOCUMENTS 3,794,518 5/1972 Howell ..... 117/227
4,219,448 8/1980 Ross ..... 252/513
4,477,296 10/1984 Nair ..... 252/513

OTHER PUBLICATIONS

Constitution of Binary Alloys, Hansen, 1958, pp. 601-603.

*Primary Examiner*—Bernard Pianalto
*Attorney, Agent, or Firm*—Albert W. Watkins

[57] ABSTRACT

Fine copper and nickel powders are well mixed in a preselected ratio with bonding agents and carriers as appropriate. The composition then may be patterned upon a substrate by screen printing and subsequent firing in a nitrogen atmosphere to produce a low sheet resistance, low TCR electrical resistor. Various alloy powders, inert materials, and glass frits may be used depending upon the desired characteristics.

8 Claims, No Drawings

METHOD OF MANUFACTURING A LOW SHEET RESISTANCE ARTICLE

BACKGROUND OF THE INVENTION

1. Field of the Invention

This invention is related generally to low sheet resistance vitreous enamel resistors such as are produced with screen printing techniques and subsequent firing.

2. Description of the Related Art

Thick film resistors and conductors most closely related to the type manifested in the present invention are manufactured by screen printing a desired pattern of electrically conductive material onto an electrically non-conductive substrate then firing the substrate at a temperature sufficient to cause bonding to take place within the material and between the material and the substrate. Electrical conduction is then able to occur along the formed pattern.

The conventional approach to formulating a low sheet resistance pattern is to use an alloy of silver and palladium, with a majority palladium. This alloy is then blended with a glass mixture and appropriate screening agents so as to provide screenability and desired resistivity.

While the sheet resistivity may be one ohm/square or less with TCR (Temperature Coefficient of Resistance) values within 100 ppm/°C. over the range of −55° C. to +125° C., the mixture is one which includes a large amount of palladium. Significantly, palladium is presently many times as expensive as base (non-noble) metals. Additionally, long term stability of palladium-silver formulations may be affected by silver migration.

In Howell U.S. Pat. No. 794,518, incorporated herein by reference, discloses an alternative method for formulating a vitreous enamel type electrical resistor. In the Howell patent, an alloy of copper and nickel is milled to a size less than 5 microns, mixed with a glass frit, and subsequently fired in a nitrogen atmosphere. The resulting material is shown in various examples to have a good TCR through the −55° C. to +125° C. temperature range.

While the approach detailed by Howell may be used to provide satisfactory resistors, several deficiencies have been observed. In starting with an alloy, an ink manufacturer is limited to the selection of commercially available alloys, which are far from unlimited in ratio between copper and nickel. The selection of ratio of copper to nickel allows significant design flexibility in customizing the ink to fit an application.

Additionally, the alloy is difficult to mill to a small size as required by the Howell disclosure, requiring a substantial amount of milling time. Impurities may be presented during the milling process which affect the reliability of the finished vitreous enamel resistor. Such impurities may require great expense in a typical manufacturing operation to pinpoint.

In the Howell method, energy is expended to form the alloy, and then again to mill the alloy to size. As in the present invention, the material disclosed by Howell will then require standard firing. This energy and extra processing to form the alloy and mill the alloy adds to the cost of the material. The time needed from order placement to ensure delivery of a finished product (order turn around time) is increased due to the extra processing.

SUMMARY OF THE INVENTION

The present invention overcomes many of the disadvantages of the prior art by using fine copper and nickel powders blended together at room temperature in a preselected ratio, adding glass compositions and screening agents as appropriate, and subsequently firing the composition to alloy the copper and nickel at a temperature below the melting point of either copper or nickel.

OBJECTS OF THE INVENTION

It is an object of the present invention to formulate a resistor having excellent TCR, low sheet resistivity, compatibility with base metal conductors and resistors of higher sheet resistivity, and outstanding environmental characteristics.

DESCRIPTION OF THE PREFERRED EMBODIMENT

In the preferred embodiment, pure copper and pure nickel powders of particle size between one and two microns are prepared. These coppers are prepared using prior art techniques such as chemical precipitation. Particularly, the nickel powder may be prepared from metal carbonyls such as $Ni(CO)_4$. Commercial sources for these powders include Grezes, Inc. of Berwyn, Pa. for the copper powder and INCO of Saddle Brook, N.J. for the nickel powder. The copper and nickel powders are mixed together. The preferred ratio of Cu/Ni is believed to be between 45/55 and 75/25, with the ideal being approximately between 55/45 and 65/35 to obtain the best TCR values while still maintaining other characteristics.

To the fine metal powder is added glass frit, inert materials such as alumina or silica, different alloy powders including Nichrome or Inconel, and screening agents such as various acrylics and solvents. The ingredients are then processed in a three roll mill to ensure the materials are well mixed.

The material is then screened onto a suitable substrate such as alumina, and subsequently fired in a conventional nitrogen belt furnace at approximately 900° C.

While copper, nickel and possible alloys therebetween all melt at temperatures of equal to or greater than 1083° C., using small diameter particles of less than 5–10 microns aids in lowering the maximum firing temperatures. The use of fine powders of average particle size on the order of one to two microns in the present invention allows for a firing temperature well within the range of standard furnaces. Thereby, the invention does not require expensive specialized equipment.

As aforementioned, the present invention is compatible with other base metal systems such as disclosed in U.S. Pat. No(s). 4,623,482, 4,639,391, 4,689,262, 4,698,265, 4,711,803, and 4,720,418 assigned to the present assignee and incorporated herein by reference. The present invention does not suffer from silver migration, as no silver is required in the formulation.

EXAMPLES

In the example, a mixture of 80% metal powder is mixed with 20% borosilicate glass frit and fired in a Watkins-Johnson brand nitrogen belt furnace at a peak temperature of 900° C. at a belt speed of 5 inches/minute.

The table below illustrates the results for various ratios of copper to nickel:

| Cu/Ni Ratio: | 45/55 | 50/50 | 55/45 | 60/40 | 65/35 |
|---|---|---|---|---|---|
| Resistivity (milliohms/ square) | 148 | 122 | 123 | 105 | 102 |
| TCR −55° C./ 125° C. (ppm/°C.) | 207/82 | 114/19 | 32/−20 | 28/−13 | 45/29 |
| Thermal Stability 150° C. 24 hr (% Δ R) | .06 | .11 | .06 | .13 | .03 |
| Δ TCR (\|Cold TCR-Hot TCR)\|) | 125 | 95 | 52 | 41 | 16 |

Varying the type or amount of the glass has been shown through further testing to have small effect on characteristics. The use of various substantially inert additives such as alumina has been shown to provide an excellent means for varying the resistivity of the formulation. For example, the addition of nine percent by weight alumina will typically increase the resistivity of the material four-fold.

While the foregoing describes what applicants believe to be the preferred embodiment at the time of filing so as by way of example and description enable one of ordinary skill in the art to make and use the invention, the invention is not limited thereto. Rather, the scope of the invention is as set forth and described in the claims appended hereto.

We claim:

1. A method of manufacturing a low sheet resistance, low TCR electrically conductive pattern comprising the steps of:

A) mixing at least two elementally different atomically unique fine metal powders with bonding agents and carriers to produce a well mixed composition, a first of said fine metal powders comprising copper and a second of said fine metal powders comprising nickel;

B) patterning said well mixed composition upon a surface;

C) heating said well mixed composition sufficiently to cause said fine metal powders to form a homogenous alloy therebetween and said bonding agents to be activated to cause bonding within said composition and between said composition and said surface wherein said heating occurs at a maximum temperature which is below the standard melting point of any of said fine metals or any possible alloys therebetween.

2. The method of manufacture of claim 1 wherein said fine metal powders are of an average particle size less than 2 microns.

3. The method of manufacture of claim 2 wherein said carriers are evaporated, conversion to a gaseous composition or otherwise removed from said composition during said heating.

4. The method of manufacture of claim 2 wherein said copper powder and said nickel powder are of purity greater than 99%.

5. The method of manufacture of claim 4 wherein the step of mixing additionally comprises adjusting said sheet resistivity of said composition prior to mixing by adding substantially inert ingredients thereto.

6. The method of manufacture of claim 1 wherein said bonding agent is comprised by glass frit.

7. The method of manufacture of claim 6 wherein said glass frit comprises primarily borosilicate glass.

8. The method of manufacture of claim 1 wherein said maximum temperature is less than 1000° C.

* * * * *